United States Patent [19]

Godel

[11] 4,122,329

[45] Oct. 24, 1978

[54] ELECTRICAL AIR HEATING APPLIANCE

[75] Inventor: Siegfried Godel, Norwalk, Conn.

[73] Assignee: Palmor International Corporation, Newark, N.J.

[21] Appl. No.: 698,273

[22] Filed: Jun. 21, 1976

[51] Int. Cl.[2] ..... H05B 3/06; F24H 3/04; A45D 20/10; H01C 1/142

[52] U.S. Cl. ..... 219/370; 34/97; 219/363; 219/368; 219/375; 219/541; 219/550; 219/551; 338/58; 338/282; 338/304; 338/321; 338/323; 338/332

[58] Field of Search ..... 219/366–368, 550, 551, 219/369–376, 379–382, 362, 363, 541, 532; 338/57, 58, 267, 268, 278, 282, 296–305, 321, 322, 323, 325, 332; 132/9, 11 R; 34/96–101, 243 R; 29/621

[56] References Cited

U.S. PATENT DOCUMENTS

| | | | |
|---|---|---|---|
| 1,106,975 | 8/1914 | Schaeffer | 338/304 X |
| 1,332,852 | 3/1920 | Levy | 338/305 X |
| 1,447,043 | 2/1923 | Rass | 338/58 X |
| 1,490,088 | 4/1924 | Bridges | 338/305 X |
| 2,536,925 | 1/1951 | Forss | 338/305 X |
| 2,962,576 | 11/1960 | Russell et al. | 219/370 |
| 3,132,232 | 5/1964 | Freedman et al. | 219/370 X |
| 3,407,279 | 10/1968 | Greenberg | 219/10.55 B |
| 3,440,386 | 4/1969 | Boehm | 219/10.55 B |
| 3,806,837 | 4/1974 | Carr et al. | 219/10.55 F |
| 4,039,774 | 8/1977 | Kata et al. | 219/370 |

*Primary Examiner*—A. Bartis

*Attorney, Agent, or Firm*—Carella, Bain, Gilfillan & Rhodes

[57] ABSTRACT

An electric air heating appliance includes a housing defining an air flow path in which is positioned a resistance heater assembly which includes a plurality of air vanes for reducing air swirling. The heater assembly includes a semi-rigid assembly of mica plates in a cruciform arrangement and stiffened by use of a corrugated resistance heating element helically wound about the plates. An improved terminal means provides a tap intermediate the ends of the helical heating element. Additional terminals means are provided for connecting the ends of the heating element to a power source. The terminal means, which are in the form of metallic strips defining extending leg segments, cooperate with an impeller fan tube surrounding an air impeller in the housing to support and captivate the heater assembly in the housing.

10 Claims, 14 Drawing Figures

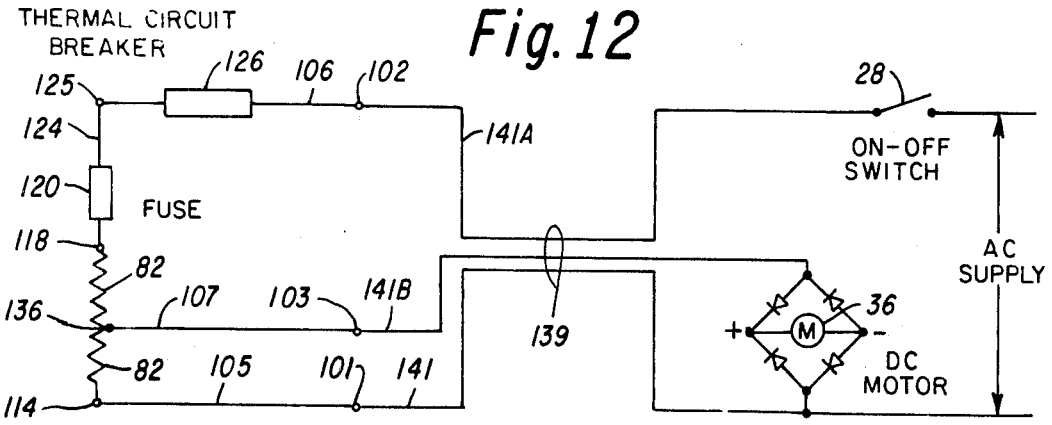
Fig. 12
Fig. 13
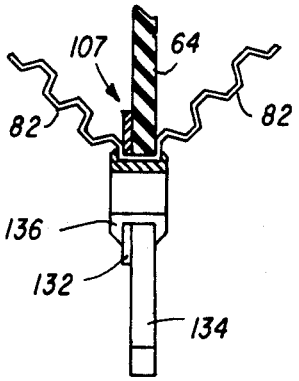
Fig. 14
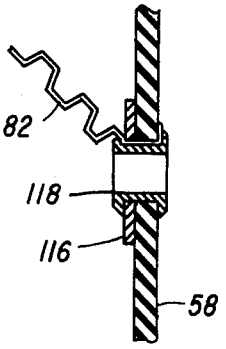

ELECTRICAL AIR HEATING APPLIANCE

BACKGROUND OF THE INVENTION

This invention relates to electrical appliances. The invention relates more particularly to improvements in electrical appliances of the type adapted to provide a stream of heated air.

In one form of electrical appliance, an electrical heater is mounted in a housing and an air stream, which is established in the housing, flows about the heater. The air stream which is thus heated is discharged from an outlet aperture of the housing and is utilized for hair treatment by curling, styling or drying.

In a particular form of this type of appliance, the heater includes an electrical resistance element which is wound in a generally helical configuration about an electrically resistive and thermally insulating support means of cruciform cross section. A heater element support means formed of mica has been utilized and is particularly useful since it exhibits desired electrically and thermally insulating characteristics.

Appliances utilizing heater arrangements of this tye have exhibited several disadvantageous characteristics. Air which is caused to flow in a stream about the heater has a cyclonic or swirling flow pattern and flows adjacent to inner surfaces of the housing thereby resulting in insufficient contact with segments of the heater element. Prior arrangements have reduced this swirling pattern to some extent by providing air vanes which cause the flow pattern to assume a more longitudinal direction. The air vanes however have been aligned with support members of the heater support means and while reducing the swirling characteristics, nonetheless result in excessive heating and glowing of heater element segments at transverse locations between the support members. These excessively hot heater element segments cause undesirable hot spots on the housing which are evident to the touch.

In a known heater arrangement, a heater element support means of cruciform cross section and which is formed of mica has been provided through the use of a pair of mica plates. These plates are slotted and are adapted for mutual engagement. The assembled plates have proven to be relatively non-rigid and reinforcement means are generally required in order to establish a relatively rigid assembly. The reinforcement means which comprises braces, for example, increases the cost of the heater element support means both in terms of additionally required parts and additional time and labor required in the assembly.

While it is desirable to provide a heater element which is continuously wound in a generally helical configuration on the support means, it is also desirable to provide means for tapping the heater element at locations which are electrically intermediate ends of the heater element. In prior arrangements, this has been accomplished by interrupting mechanical continuity in the winding in order to establish the desired tap. This interruption in the helical winding undesirably requires additional time in the assembly of the heater which increases the cost of the heater.

The use of mica as a heater support means is preferable because of its desirable electrically and thermally insulative physical characteristics. However, this material and other suitable equivalent materials exhibit a brittleness which frequently results in breakage of the mica at locations in the appliance where the mica is supported.

Accordingly, it is an object of this invention to provide an improved electrical appliance having means for heating an air stream.

Another object of the invention is to provide an electrical appliance having a resistive heater element about which an air stream flows and wherein relatively enhanced uniform heating of the air stream is provided.

Another object of the invention is to provide an improved heater arrangement in an electrical appliance which eliminates excessively hot segments along the heater element.

Another object of the invention is to provide an improved heater of substantially rigid construction.

A further object of the invention is to provide an improved means for tapping a heater element in an electrical appliance.

Another object of the invention is to provide an improved means for supporting a resistance heater formed of a relatively brittle support material and for effecting electrical contact with the heater element.

SUMMARY OF THE INVENTION

In accordance with features of this invention, there is provided an electrical appliance having a housing including a housing member, a heater positioned within the housing member, and means for establishing an air stream through the housing member. The heater includes a support means having a plurality of support members which extend from a longitudinal axis thereof. A resistance heater element is wound about the support members and extends in a longitudinal direction. A first air vane means is provided and is positioned between the heater element and an inner surface of the housing member and is aligned with the heater support members. A second air vane means is also provided and is positioned between the heater and the inner surface of the housing at a location intermediate the heater support members. The air vane means operate to interrupt swirling motion of the air stream and to enhance longitudinal air flow through the housing member thereby eliminating excessive heating and glowing of segments of the heater element.

In accordance with other features of the invention, a heater assembly is provided which includes a plurality of plate members arranged in a relatively non-rigid assembly and a heater element formed of a corrugated strip which is wound about the support means in a helical configuration. The corrugated heater strip provides stiffening and a substantially rigid assembly, an increased heating surface, and reduced heater watt-density.

In accordance with another feature of the invention, relatively rigid, electrically conductive strips having support leg segments are mounted to and extend from one end of the heater for supporting and captivating the relatively brittle support members in the housing with the support leg segments providing electrical contact with the electrically conductive strips.

A terminal slot is formed in one of the support members of the support means and a segment of an electrically conductive strip includes a slot aligned therewith and in which the heater element is positioned. A deformable body is positioned in the slot for mechanically securing the heater element therein thus providing a tap for a continuously wound and uninterrupted heater element.

These and other objects and features of the invention will become apparent with reference to the following specification and the drawings.

THE DRAWINGS

In the drawings:

FIG. 12 is a schematic circuit diagram of the electric circuit elements shown in FIG. 7;

FIG. 13 is a fragmentary view taken along line 13—13 of FIG. 6; and,

FIG. 14 is a fragmentary view taken along line 14—14 of FIG. 2.

DETAILED DESCRIPTION

Figure 1:
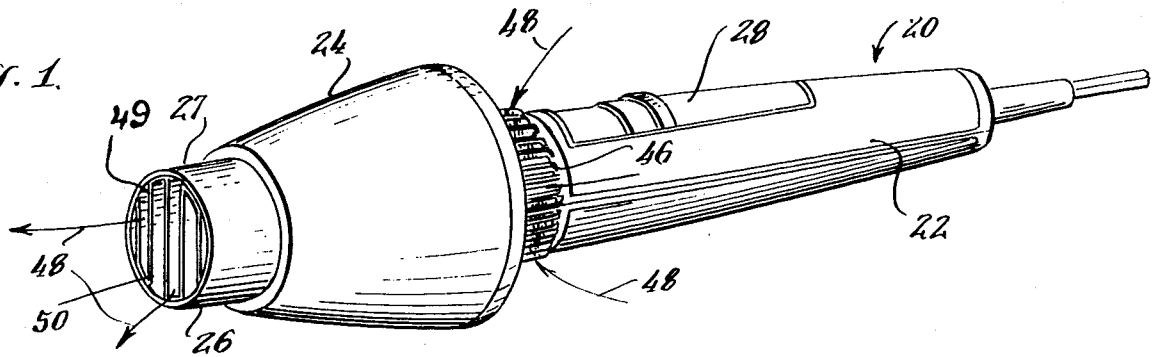
FIG. 1 is a perspective view of a hand-held electrical appliance constructed in accordance with features of this invention.
Figure 2:
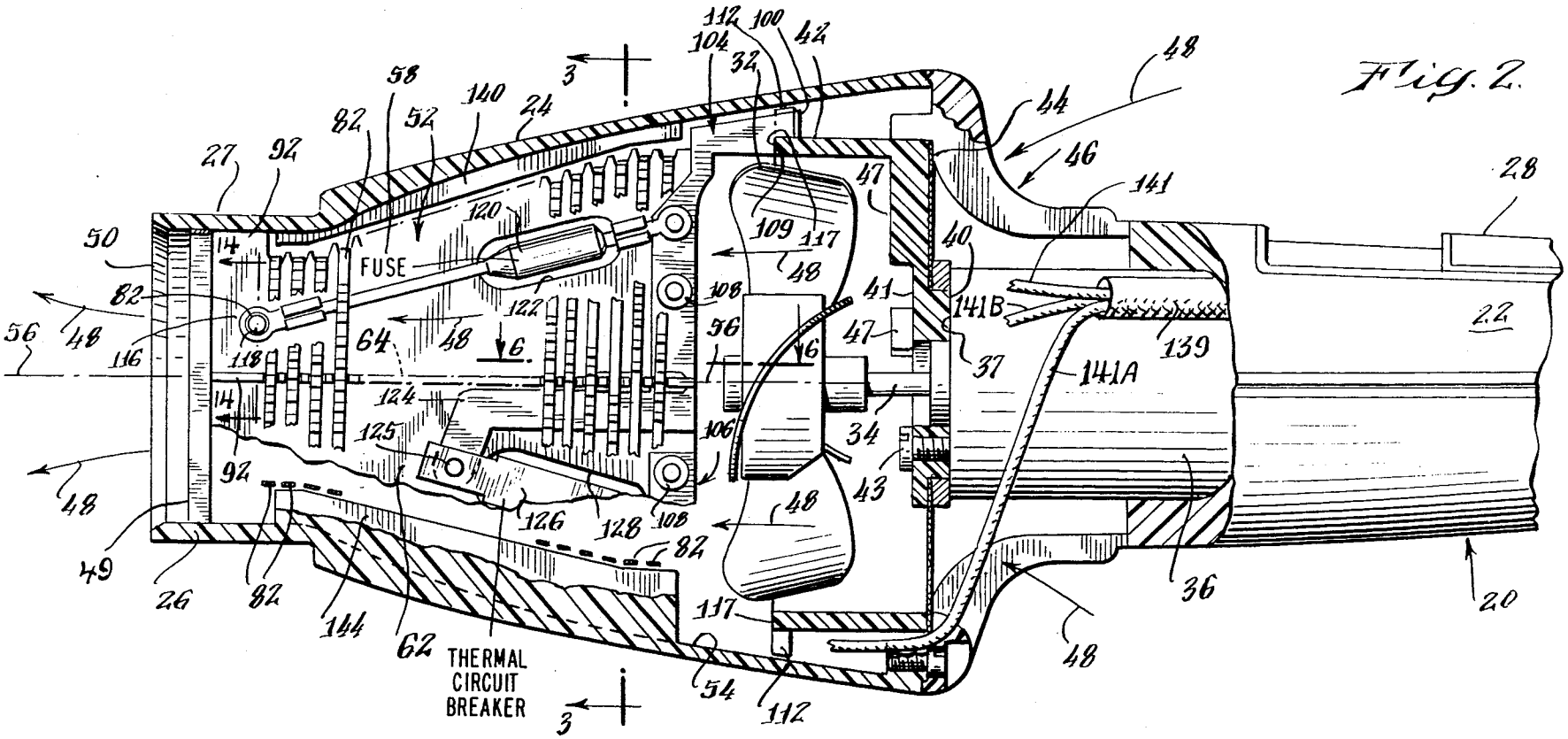
FIG. 2 is an enlarged, fragmentary, side elevation view, partly in section, of the appliance of FIG. 1.

Referring now to the drawings and particularly to FIGS. 1 and 2, a hand-held appliance is shown for the treatment of hair by curling, styling or drying. The appliance is shown enclosed in a housing 20 which includes an elongated, tapered handle member 22 and a frustoconically shaped housing member 24 which includes an integrally formed cylindrically shaped segment 26. The segment 26 is adapted to receive in engagement therewith at a surface 27 any one of a number of demountable personal grooming attachments, not shown, such as a comb, brush, curler, etc. A hand actuated switch means 28 is provided for selecting a desired one of a plurality of operating modes.

A means for establishing an air stream through the housing member 24 is provided and comprises a motor driven impeller 32 and air inlets and outlets for the appliance housing. The impeller 32 is mounted on a shaft 34 of an electric motor 36 for rotation therewith. One end 37 of the motor 36 abuts against the surface 40 of a hub 41 of an impeller fan tube 42 and is mounted thereto by screws 43. The fan tube 42 is centrally located and is positioned against a surface 44 of a flared out air inlet grill segment 46 of the handle housing member 22. Tube 42 includes spokes 47 which extend radially from the hub 41. The tube 42 is secured against the surface 44 by screws which, for purposes of simplifying the drawings, are not illustrated.

Energization of the motor 36 causes rotary motion of the impeller 32 and the flow of air in a stream as indicated by arrows 48 through the grill segment 46, between the spokes 47 of the fan tube 42, through the interior of the housing member 24, past an outlet grill 49 and from an outlet aperture 50 of the cylindrical segment 26. Air flowing in the stream passes over a heater, referred to generally as 52, and is heated. The air effluent from the aperture 50 flows at a rate and at a temperature selected by operation of the mode switch 28. A circuit arrangement for electrically energizing the heater and motor in accordance with a desired mode of operation is provided by known circuit means and further detailed discussion herein is believed unnecessary.

The resistance heater 52, which is positioned within the housing member 24 and is spaced apart from an inner surface 54 thereof, includes an elongated heater element support means having a longitudinal axis 56. The heater support means (FIG. 7) is provided by a plurality of support members 58, 60, 62 and 64 which extend radially from the axis 56 toward the inner surface 54 of the housing member 24. The support members 58, 60, 62 and 64 each have elongated distal edges 66, 68, 70 and 72 respectively which extend in the direction of the longitudinal axis 56. The support members 58 and 62 are provided as integral segments of an electrically and, thermally insulative plate 74 which tapers in width for a part of its length. Similarly the support members 60 and 64 are provided as integral segments of an electrically and, thermally insulative plate 76. One suitable electrically and, thermally insulative material from which the plates 74 and 76 are fabricated is mica. Although in the preferred arrangement shown, the support members are provided as integral segments of plates which are assembled into a cruciform cross sectional configuration, the members may be provided by other means and may be assembled in other cross sectional configurations wherein the members extend from the axis 56 toward the inner surface 54.

Figure 7:
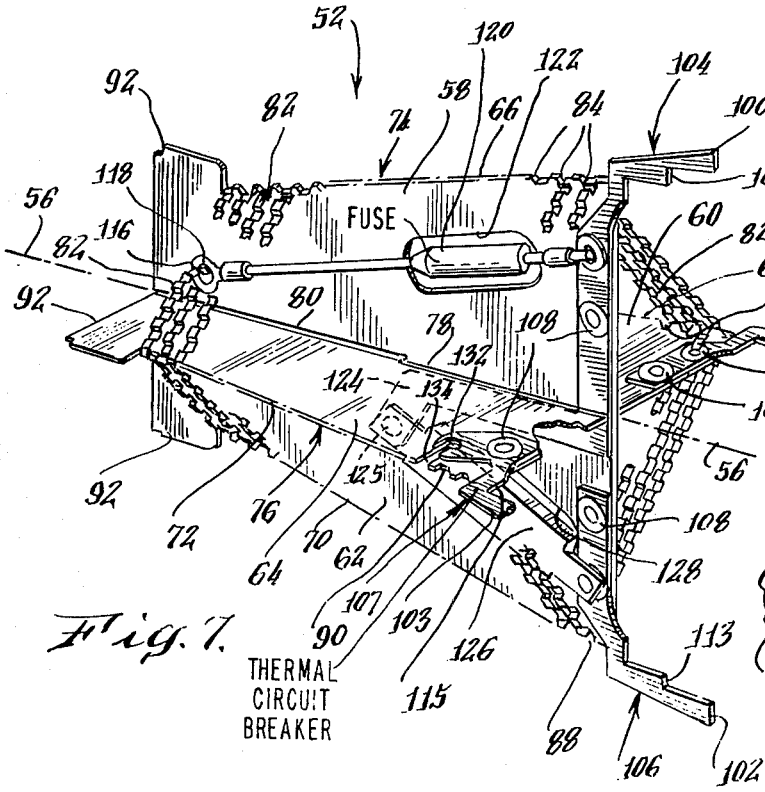
FIG. 7 is a perspective view, partly broken away, of a heater utilized with the appliance of FIG. 1.

A means for assembling the plates 74 and 76 to provide a substantially non-rigid or relatively loose fitting heater support members comprises the slot 78 centrally formed along about one half of the length of the plate 76 in the direction of the longitudinal 56 and a slot 80 centrally formed along about one half of the length of plate 74 in the direction of the longitudinal axis 56. The plates 74 and 76 can then be mutually engaged as illustrated in FIG. 7 to provide a cruciform cross sectional configuration. This assembly is substantially non-rigid in that the assembled plates 74 and 76 can be deflected to a limited extent about the axis 56.

The heater 52 further includes a resistance heater element 82 which is wound about the heater support members at the edges 66, 68, 70 and 72 and extends in a generally helical configuration in the direction of the longitudinal axis 56. The heater element 82 comprises a corrugated ribbon or strip of electrical resistance material, such as Hoskins No. 750 Alloy, which is corrugated by passing the ribbon between the teeth of two spur gears. The ribbon heater element is positioned in longitudinally extending arrays of slots 84, 86, 88 and 90 which are formed at the edges 66, 68, 70 and 72 respectively. The corrugated heater element operates to stiffen the assembled plates 74 and 76 to the extent of the strength of the mica, resulting in a relatively rigid assembly and eliminates the need of further reinforcing means.

Figure 4:
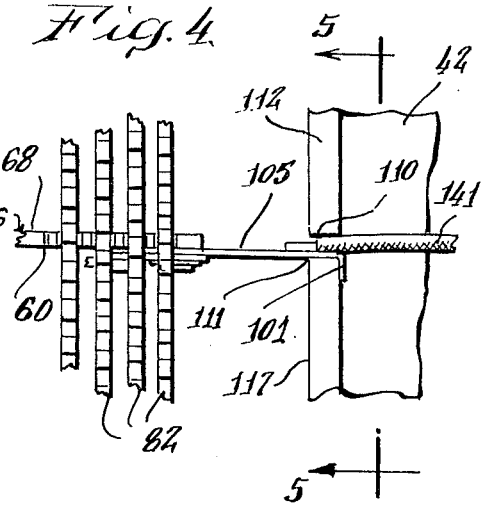
FIG. 4 is a fragmentary view showing the manner of electrical conductive support strips.
Figure 5:
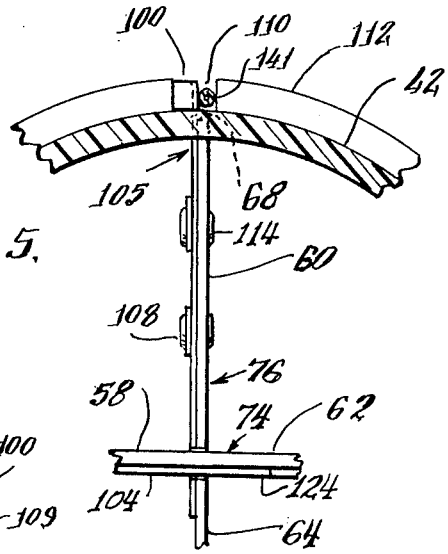
FIG. 5 is a fragmentary view taken along lines 5—5 of FIG. 4.
Figure 6:
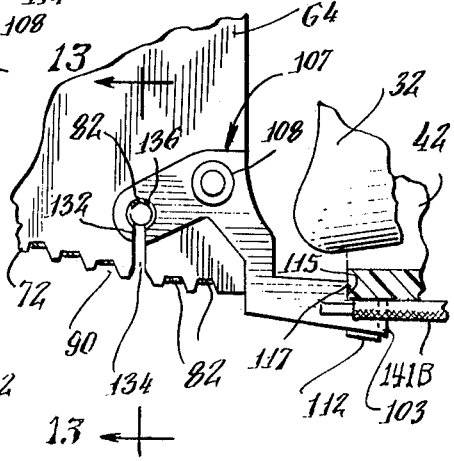
FIG. 6 is a fragmentary view taken along lines 6—6 of FIG. 2.

The heater 52 is positioned in the housing member 24 in such manner that the heater element 82 is supported in a spaced apart relationship with respect to the inner surface 54 of the housing. The heater 52 is supported at one end thereof near the air flow outlet 50 of the housing segment 26 by tab segments 92 which are integrally formed in the plates 74, 76. It is supported at an opposite end at the fan tube 42 by leg segments 100, 101, 102 and 103 of electrically conductive strips 104, 105, 106 and 107 respectively which are mounted on the plates 74 and 76. The strips 104, 105, 106 and 107 are formed of an electrically conductive metal such as brass, for example, having a thickness for providing relatively stiff leg segments but which can be flanged over. Shoulders 109, 111, 113 and 115 (FIGS. 6 and 7) are formed in the strips 104, 105, 106 and 107 respectively. The strips are secured to the plates by deformable bodies, such as rivets or eyelets 108, which extend through aligned apertures in both the strips and plates and are then deformed to secure the strips thereto. As illustrated in FIG. 4, shoulder 111 of strip 105 is positioned to abut against a surface 117 of the fan tube 42. The leg segment 101 of strip 105 extends through a slot 110 formed in a shoulder 112 of the fan tube 42. The leg 101 is then flanged over as shown to secure the heater 52 to the fan tube. The strip shoulders 109, 113 and 115 are similarly positioned and the leg segments 100, 102 and 103 similarly extend through slots, not shown, which are formed in tube shoulder 112. The strip shoulders 109, 111, 113 and 115 are dimensioned and are at a radial location with respect to the axis 56 so as to conform in dimension with the inside diameter of the slots in the circular shaped shoulder 112. Assembly of the heater 52 to the fan tube 42 is accomplished by axially positioning the heater 52 until strip shoulders 109, 111, 113 and 115 contact fan tube surface 117; rotating the heater 52 until the leg segments 100, 101, 102 and 103 contact surfaces of the slots; and flanging over the leg segments. The heater 52 is then supported and captivated in an axial direction and radial direction.

Electrical connection between opposite ends of the heater element 82 is provided by the strip 105 and the strip 106. The corrugated ribbon element 82 extends through an aperture formed in the strip 105 and an aligned aperture formed in the plate 76. An eyelet 114 is positioned in these apertures and is deformed therein to mechanically secure the element and to establish electrical connection between the element and strip 105. An opposite end of the element 82 extends through a circular terminal lug 116 and an aperture in plate 74. It is secured therein by an eyelet 118 which is positioned in the lug 116 and the aperture in plate 74. The lug eyelet 118 is deformed to mechanically secure this end of the element 82 in the aperture and to provide electrical connection between this end of the element and the circular lug 116. A fuse 120 is positioned in a cutout 122 formed in the plate 74 and is electrically coupled in series between the circular lug 116 and the strip 104. The strip 104 includes a segment 124 (FIG. 2) which extends longitudinally toward an aperture 125 formed in the support member 62. A bimetal circuit breaker 126 is positioned in a cutout 128 (FIG. 2) formed in the support member 62 and extends between the aperture 125 and the strip 106. Eyelets secure this circuit breaker to the support member 62 and in electrical connection with the strip segment 124 at aperture 125 and at the strip 106.

The element 82 (FIG. 6) is tapped at a location which is electrically intermediate the strips 106 and 105 by the electrically conductive strip 107 having a slot 132 formed therein and in alignment with a terminal slot 134 formed in the support member 64. The terminal slot 134 extends inward from the edge 72 toward the longitudinal axis 56 for a distance substantially greater than the edge slots positioned along the edge for receiving the element 82. A segment of the element 82 is positioned in terminal slot 134 and electrical coupling to the strip 107 is provided by a terminal slot eyelet 136 which is also positioned in strip slot 132 and is deformed to secure the ribbon in position and provide an electrical connection with the strip 107. A heater tap is thus provided at leg segment 103.

Electrical connections, best shown in FIG. 12 between the strips 105, 106, and 107 is provided by a lead wire cable 139 having lead wires 141, 141A and 141B which are connected to these strips by soldering for example and to the motor 36, switch 28 and other circuit elements located in handle housing member 22. This is exemplified in FIG. 4 which illustrates a lead wire 141 of the cable 139 soldered to a part of the leg segment 101 of strip 105. Each of the lead wires extends axially over the surface of the fan tube from associated strips and are gathered together in the cable 139 as shown in FIG. 2. This strip and lead wire arrangement is advantageous in that it provides a convenient arrangement for conveying conductors in an axial direction past the impeller 32.

Figure 3:
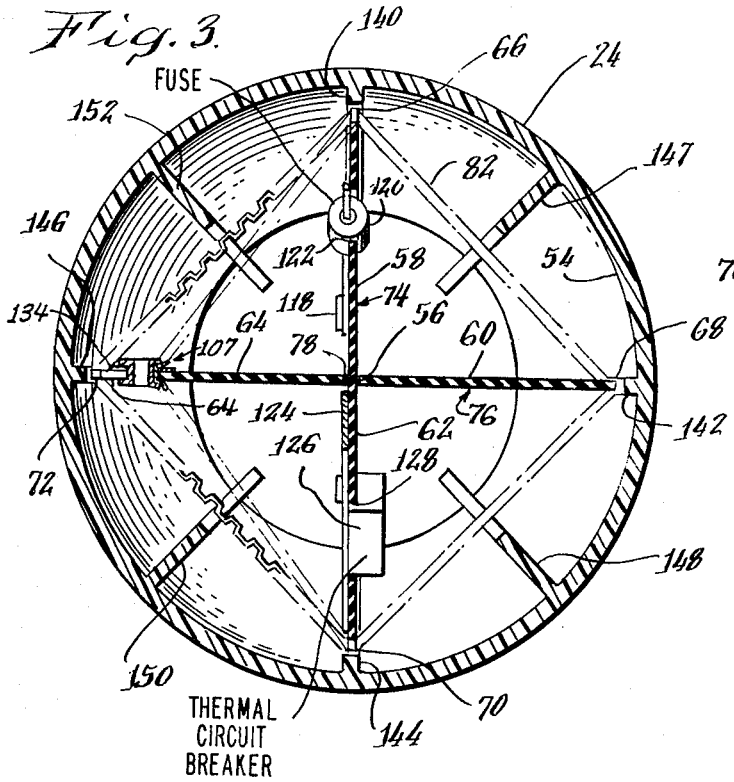
FIG. 3 is a sectional view along lines 3—3 of FIG. 2.

A first elongated air vane means is provided and is positioned between the heater 52 and the inner surface 54 of the housing member 24. This first elongated air vane means comprises a plurality of elongated fins 140, 142, 144, and 146 (FIG. 3) which are aligned radially with the support members 58, 60, 62 and 64 respectively. A second elongated air vane means is also provided and is positioned between the heater 52 and the inner surface 54 of the housing member 24 at a location intermediate adjacent support members of the heater support means. In FIG. 3, the second air vane means is shown to comprise a plurality of fins 147, 148, 150 and 152 which are positioned intermediate the support members 58 and 60, 60 and 62, 62 and 64, and 64 and 58 respectively. The fins 140–152 are supported from the inner surface 54 of the housing and extend adjacent to but are spaced apart from the heater element 82. In a preferred arrangement, the fins are integrally formed with the housing member 24 as illustrated in FIGS. 2 and 3. The air stream which is established in the housing is established by the axial impeller 32 which creates a cyclonic air flow having a pressure gradient extending from a relatively low pressure near the axis 56 to a relatively higher pressure at the inner surface 54 of the housing member 24. The air stream tends to swirl in its passage through the housing member 24 and hot spots develop along the heater element 82 in those locations of relatively lower air flow. These hot sports have caused undesirable hot spots on the outer surface of the housing. The provision of the air vane means operates to reduce the swirling and cyclonic flow and to establish a longitudinal flow of air through the housing thereby resulting in more uniform heating of the air stream. More particularly, the second air vane means provided by the fins 147–152 substantially reduce the excessive heating and glowing of heater element segments which has previously occurred in those segments of the heater element located intermediate the wall members. The air vane fins 140–152 extend radially toward but are spaced apart from the heater element 82. By providing this spacing, hot spots are avoided and a relatively low cost, low temperature plastic housing and integral fin arrangement can be utilized. One such material comprises a polycarbonate polymer plastic such as LEXAN. The distance of this spacing is established at a value for maintaining the temperature at the inner edges of the air vane at a value below its softening temperature.

Figures 8, 9, 10, 11:
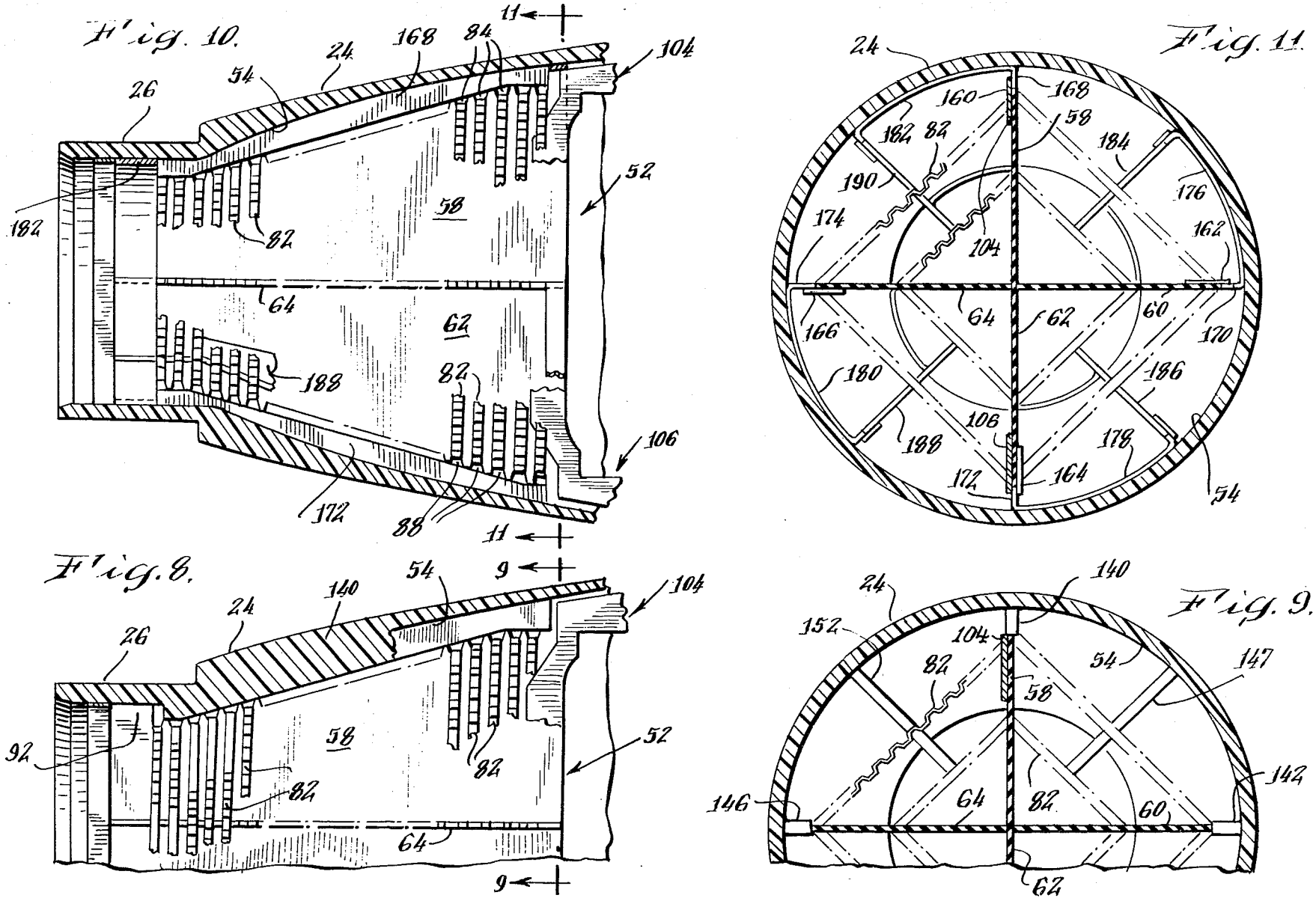
FIG. 8 is a fragmentary side elevation view, partly in section and partly broken away, of the appliance of FIG. 1 illustrating an alternative embodiment of a heater and housing member.
FIG. 9 is a view taken along lines 9—9 of FIG. 8.
FIG. 10 is a fragmentary side elevation view, partly in section and partly broken away, of the appliance of FIG. 1 illustrating an alternative embodiment of a heater and housing member.
FIG. 11 is a view taken along lines 11—11 of FIG. 10.

There is illustrated in FIGS. 8 and 9 an alternative air vane arrangement utilizing a housing formed of a relatively high temperature plastic such as a phenolic or a polamide. One suitable polamide comprises VESPEL. In this case, the air vane fins extend to and substantially abut against the heater element 82. The softening temperature of this relatively higher temperature plastic exceeds the operating temperature of the abutting heater element 82.

FIGS. 10 and 11 illustrate a further embodiment wherein the first and second air vane means comprise members which are supported from heater support means. Brackets 160, 162, 164 and 166 are provided for supporting longitudinally extending first air vane means comprising members 168, 170, 172 and 174 respectively. These brackets are secured to the support members and position the first air vane means in alignment with edges of the support members between the inner surface of the wall 54 and the edges. Arcuate shaped arms 176, 178, 180 and 182 are provided and are also supported from the brackets 160–166 for supporting second air vane means comprising members 184, 186, 188 and 190 at positions intermediate the support members 58–64. These vane members are formed of mica or other suitable material and function in the manner described hereinbefore for establishing longitudinal flow of the air stream.

The appliance thus described exhibits various advantageous features. In particular, the improved air vane means described herein operates to reduce swirling in the air stream flowing through the housing and to establish a relatively more uniform longitudinal air flow pattern through the housing. As a result glowing of intermediate segments of the heater element is eliminated and hot spots in the housing which would be noticeable in handling the appliance are avoided. Furthermore, the establishment of a flowing air stream of relatively uniform longitudinal flow pattern provides for a uniform heating of the air mass which flows through the appliance.

The provision of a heater element shaped as a corrugated ribbon as described herein advantageously presents a relatively large heating surface to the flowing air stream and reduces the watt density. Edges of the ribbon which are presented to the air stream represent a relatively low flow impedance and thus enhance the air flow through the housing. Furthermore, the use of the corrugated ribbon heater element operates to stiffen and form a relatively rigid heater support means from support members which otherwise could constitute a relatively non-rigid assembly. The arrangement described herein maintains the desired heater geometry during subsequent assembly of the appliance and eliminates previous requirements for additional bracing means thereby reducing the cost of the heater and appliance.

The use of the strips described herein provides an improved arrangement for supporting a heater having heater element support members fabricated of a relatively brittle material such as mica and avoids corner breakage of the material at heater support points. The strips advantageously mechanically position and captivate the heater in the housing and provide electrical coupling between the heater element, a fuse, a circuit breaker, and lead wires for coupling the heater to other circuit means. These electrical connections are further facilitated in that the strips provide for electrical coupling in an axial direction about the impeller and eliminate other relatively more complicated and cumbersome means for dressing lead wires about the impeller. In addition to providing these electrical characteristics, the strips provide mechanical support for and captivation of the heater to the fan tube within the housing thereby facilitating assembly of the appliance.

An improved means for tapping the heater element is also provided. This means eliminates the prior necessity for mechanically interrupting the heater element in order to establish a tap at a location electrically intermediate the ends of the element. This tapping arrangement can be utilized not only with the corrugated ribbon heater element illustrated and described herein but also with other forms of heater elements such as helical coil wire elements and the like.

While there has been described various embodiments of the invention, it will be apparent to those skilled in the art that variations may be made thereto without departing from the spirit of the invention and the scope of the appended claims.

What is claimed is:

1. In a heater for an electrical appliance comprising an elongated heater support means, formed of an electrically and thermally insulative material, having a longitudinal axis and a plurality of heater element support members extending radially from said axis, said members having elongated distal edges extending in the direction of said axis, a resistance wire heater element having a length thereof, said element wound in a helical configuration about said support members at said edges and extending in the direction of said axis, the improvement comprising means for providing an electrical connection at a location along the length of said element intermediate the ends thereof comprising an open terminal slot formed in a support member and extending inwardly from an edge thereof toward said longitudinal axis, a strip of electrically conductive material positioned in juxtaposed relationship with said support member and having an open slot formed therein which conforms with and is positioned in alignment with said open terminal slot in said support member, a segment of said wound heater element positioned in said aligned slots, and means for securing said segment in said slots and in electrical connection with said electrically conductive strip.

2. The heater of claim 1 wherein said means for securing said segment of said heater element in said slots comprises a mechanically deformable body positioned in said slots and adapted to be deformed in said slots for captivating said element in said slots.

3. The heater of claim 2 wherein said deformable body comprises an eyelet.

4. The heater of claim 2 wherein said electrically conductive strip includes a terminal segment for connecting said heater element to a circuit means.

5. An electrical appliance comprising;

a. a hollow housing member having an air inlet and an air outlet;

b. means for establishing an airstream through said housing member and including a motor driven impeller and an impeller fan tube surrounding said impeller;

c. means positioned in the housing member adjacent one end of said fan tube for heating said airstream;

d. said heating means having a longitudinal axis and including a plurality of electrically insulative support members extending radially from said axis;

e. a heater element helical wound about said axis on said support members in the direction of said axis;

f. means on said fan tube and heating means for mounting and locating said heating means relative to said fan tube, said mounting and locating means including slots in the fan tube for mounting and locating the heating means in both axial and radial directions;

g. said mounting and locating means further including a plurality of electrically conductive strips fastened to the support members and having segments thereof extending in the direction of said axis through said slots and being fixed to said fan tube for mating engagement with the fan tube slots.

6. The appliance of claim 5 wherein said heater element comprises an elongated member having opposed ends, said heater element is continuously helically wound about the support members, and wherein said heating means include means for securing said opposed ends in electrical connection with respective ones of a pair of said conductive strips, said pair of conductive strips being electrically insulated from each other.

7. The appliance of claim 6 wherein at least another one of said conductive strips includes means for electrically tapping the continuously wound heater element intermediate said opposed ends, said at least another one of said conductive strips being electrically insulated from said pair of conductive strips.

8. The appliance of claim 6 wherein an electrical supply control circuit cable is provided with lead wires attached to said pair of conductive strips for selective energization of said heating element.

9. The appliance of claim 8 wherein said fan tube includes a wall having an inner and outer surface, said impeller being positioned within and spaced from said inner surface, and said outer surface having fan tube slots formed therein with the lead wires laying along the outer surface for mating engagement with the fan tube slots.

10. An electrical appliance comprising;

a. hollow housing member having an air inlet and an air outlet;

b. means for establishing an airstream through said housing member and including a motor driven impeller and and an impeller fan tube surrounding said impeller;

c. means positioned in the housing member adjacent one end of the fan tube for heating said airstream;

d. said heating means having a longitudinal axis and including a plurality of electrically insulative support members extending radially from said axis;

e. means on said fan tube and heating means for mounting and locating said heating means relative to said fan tube, said mounting and locating means including slots in the fan tube for mounting and locating the heating means in both axial and radial directions;

f. said mounting and locating means further including a plurality of electrically conductive strips fastened to the support members and having segments thereof extending in the direction of said axis through said slots and being fixed to said fan tube for mating engagement with the fan tube slots;

g. a heater element comprising an elongated member having opposed ends, said heater element being continuously helically wound about the support members in the direction of said axis and said heating means including means for securing said opposed ends in electrical connection with respective ones of a pair of said conductive strips, said pair of conductive strips being electrically insulated from each other.

h. at least another one of said conductive strips including means for electrically tapping the continuously wound heater element intermediate said opposed ends, said at least another one of said conductive strips being electrically insulated from said pair of conductive strips;

i. said tapping means including a first open slot in at least one of said support members extending toward said axis and a second open slot in said at least another one of said conductive strips in alignment with said first open slot, said aligned slots adapted for receiving a portion of the continuously wound heater element intermediate said opposed ends and means for securing said heater element portion in electrical connection with said at least another one of said conductive strips.

* * * * *